US005156121A

United States Patent [19]

Routery

[11] Patent Number: 5,156,121

[45] Date of Patent: Oct. 20, 1992

[54] PISTON-CONNECTING ROD ASSEMBLY

[76] Inventor: Edward E. Routery, 2900 W. Highland, Chandler, Ariz. 85226

[21] Appl. No.: 530,754

[22] Filed: May 30, 1990

[51] Int. Cl.[5] ..... F02B 75/32

[52] U.S. Cl. ..... 123/197.3; 74/579 E; 92/187

[58] Field of Search ..... 123/197 AB, 197 AC; 74/579 E, 579 R, 47; 92/187

[56] References Cited

U.S. PATENT DOCUMENTS

| | | | |
|---|---|---|---|
| 1,420,236 | 6/1922 | Bohman | 123/197 A |
| 1,566,486 | 12/1925 | Lee | 123/197 R |
| 1,873,908 | 8/1932 | Schinke . | |
| 2,287,472 | 6/1942 | Eby . | |
| 3,859,976 | 1/1975 | McWhorter | 123/197 AB |
| 4,085,628 | 4/1978 | McWhorter | 74/579 E |
| 4,463,710 | 8/1984 | McWhorter | 123/197 AB |
| 4,467,756 | 8/1984 | McWhorter | 123/197 AB |
| 4,584,972 | 4/1986 | Jayne et al. | 123/56 C |
| 4,890,588 | 1/1990 | Tillman | 123/197 AB |
| 4,974,554 | 12/1990 | Emery | 123/197 AB |

FOREIGN PATENT DOCUMENTS 1170326 11/1969 United Kingdom .

*Primary Examiner*—David A. Okonsky

*Attorney, Agent, or Firm*—Robbins, Dalgarn, Berliner & Carson

[57] ABSTRACT

A piston-connecting rod assembly for a crank shaft creates periods of transition, such as dwell, in engines or compressors. The piston, which reciprocates in compression and power strokes, is connected to the connecting rod by upper and lower piston pins. The connecting rod has (a) a lower end portion for connecting the connecting rod to the crank shaft, (b) a central portion having a central portion opening for receiving the lower piston pin, and (c) an upper end portion having an upper end portion opening for receiving the upper piston pin.

53 Claims, 3 Drawing Sheets

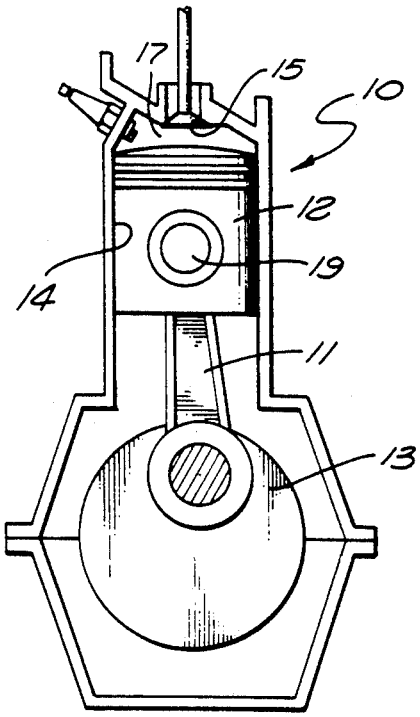
FIG. 1
PRIOR ART
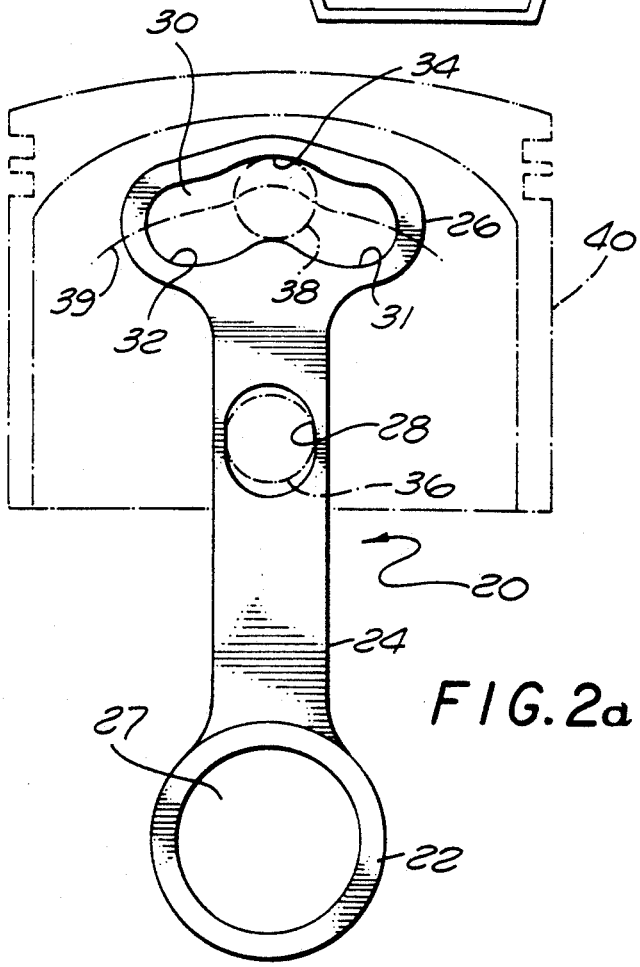
FIG. 2a
FIG. 2b
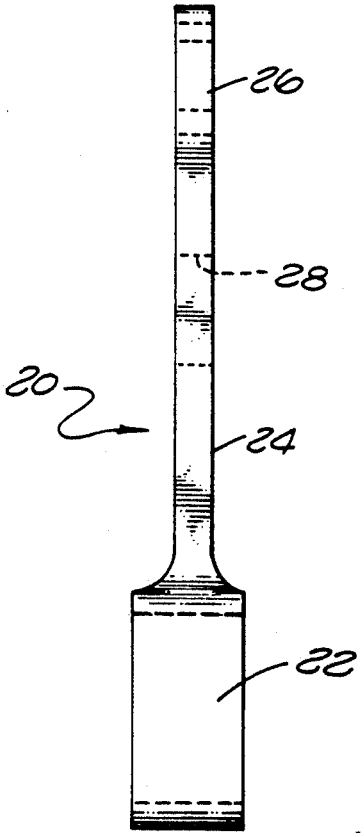

FIG. 4
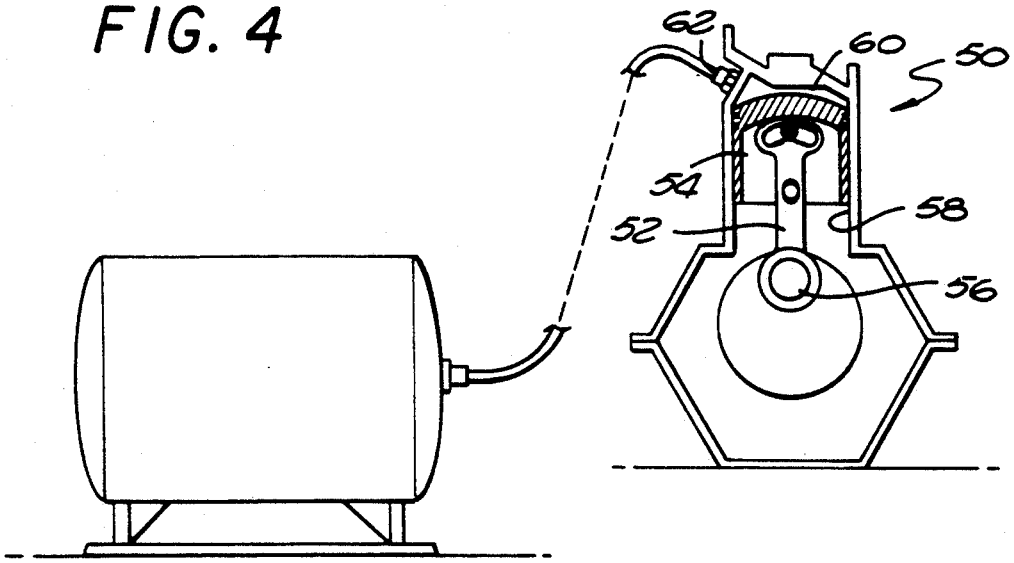
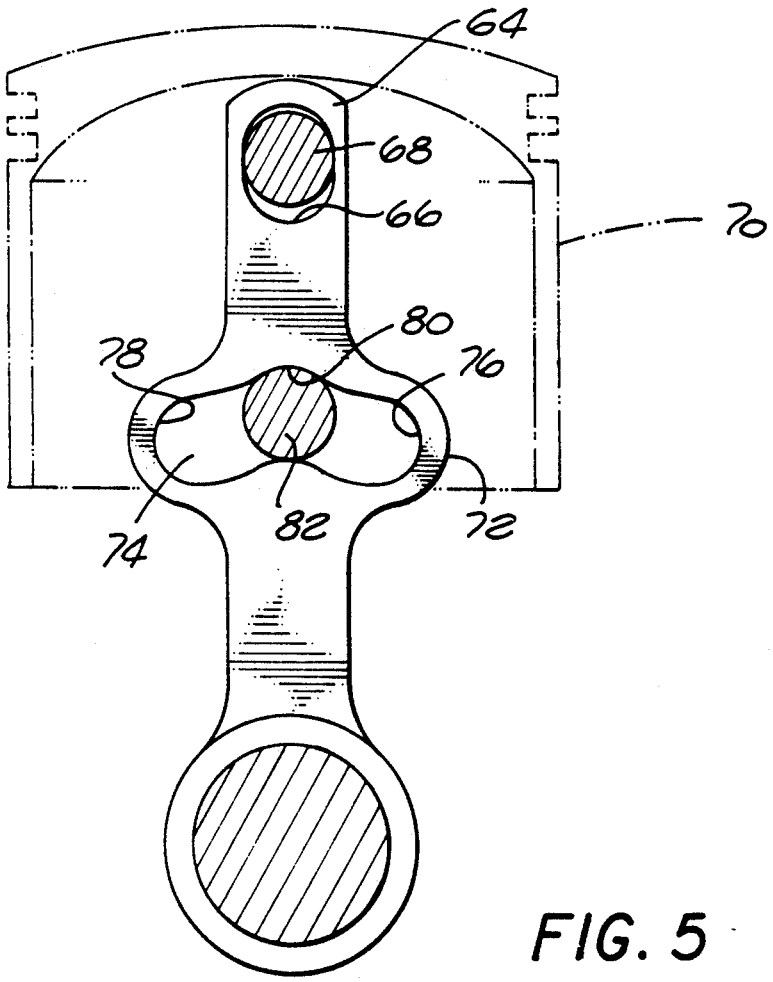
FIG. 5

PISTON-CONNECTING ROD ASSEMBLY

BACKGROUND OF THE INVENTION

1. Field of the Invention

This invention relates to the mechanical arts. In particular, it relates to combustion engines.

2. Discussion of the Related Art

In an internal combustion engine, power is developed as a mixture of fuel and air is compressed by a piston in a cylinder and then ignited. In conventional engines, combustion occurs when the piston is at, or substantially at, the top dead center (or TDC). The period for combustion generally lasts for no longer than the time it takes the crank shaft to rotate about 2 to 4 degrees past top dead center.

The ignited gases force the piston down the cylinder. However, as the piston moves down the cylinder, the gases expand and cool and begin to lose their force.

The piston is attached to a connecting rod which in turn is attached to a crank shaft. It is the function of the connecting rod to convert the reciprocal motion of the piston being forced down the cylinder (a power stroke) and then returned back to top dead center (a compression stroke) into the rotary motion of the crank shaft.

It is desirable to cause ignition of the mixture of fuel and air at the moment of greatest compression, if maximum power and efficiency are to be obtained. The greater the compression or the tighter the squeeze the more heat that is generated during burning and the greater the force that can be used to drive the crank shaft. Consequently, ignition is timed so that the charge of fuel and air combusts when the piston is at, or substantially at, the limit of its upward movement in the cylinder.

If the ignition of the mixture of fuel and air occurs slightly before top dead center, then at the moment the mixture is ignited, some of the force developed by the explosion is wasted or lost, because it opposes the upward movement of the piston. If the ignition of the mixture occurs precisely at top dead center, there is also an initial loss of power, because the explosive force is expended along the connecting rod, which at TDC is directly aligned with the crank shaft. This loss of power, due to the alignment of the connecting rod, also occurs when the crank shaft is only a few degrees past top dead center.

Maximum efficiency is not obtained until the crank shaft rotates a sufficient amount to permit the explosive force to be expended in driving the crank shaft downwardly instead of laterally. It is, therefore, desirable to have the initial expansion occur when the crank shaft is well past dead center, so that the force of the expanding gases is utilized in the application of a turning force upon the crank shaft. However, in conventional engines, if the explosion is timed to occur when the crank is past dead center, the explosion will occur when the gases are not at peak compression and hence will not develop the maximum possible force.

In accordance with some embodiments of the instant invention, the period of high compression is extended beyond the relatively short period which occurs in conventional engines. This increase in the high compression period results in a constant volume burn and ensures that the initial expansion will not occur until the crank is well past top dead center. The advantages of constant volume combustion are outlined, for example, in Deglar, H. E., "Internal Combustion Engines", John Wiley & Sons, 1938, pp. 77 to 98 and Obert, E. F., "Internal Combustion Engines and Air Pollution", Harper & Row, 1973, pp. 166 to 175. In addition to maximizing the efficiency of the initial expansion, the extended period of high compression, or dwell, ensures that the fuel is completely burned, thereby further improving efficiency and materially decreasing undesirable exhaust products. The longer the constant volume burn, the cleaner, the quieter and the less polluting is the operation of an engine.

SUMMARY OF THE INVENTION

The piston-connecting rod assembly, in accordance with the invention creates periods of transition, such as dwell, between the compression and power strokes of engines or compressors. A piston, which reciprocates in compression and power strokes, is attached to a connecting rod by portions of a lower piston pin and an upper piston pin. The connecting rod includes (a) a lower end portion for connecting the connecting rod to the crank shaft, (b) a central portion having a central portion opening for receiving a portion of the lower piston pin, (c) an upper end portion having an upper end portion opening for receiving a portion of the upper piston pin.

In some embodiments, the central portion opening is elongated and has a maximum width which is substantially the same as the portion of the lower piston pin to be received in the opening; the length of the central portion opening is sufficient that its ends do not interfere with the reciprocation of the piston; the width of the upper end portion opening is substantially the same as the portion of the upper piston pin to be received in the opening; and the length of the upper end portion opening is sufficient that its ends do not interfere with the reciprocation of the piston.

In these embodiments, the wall structure of the upper end portion opening defines a compression region, a power region, and a transition region, disposed between said compression and said power regions. The midline of compression and power regions of the upper end portion opening substantially follows a curve having a radius substantially equal to the distance between the lower piston pin and the upper piston pin. The midline of the transition region of the upper end portion opening follows an altered curve between the power and compression regions. The walls defining the compression region cause the piston to move in substantial concert with the rotation of the crank shaft during the compression stroke, the walls defining the power region cause the piston to move in substantial concert with the rotation of the crank shaft during the power stroke, and the walls defining the dwell region cause the piston to cease moving in concert with rotation of the crank shaft, between the compression and power strokes.

BRIEF DESCRIPTION OF THE DRAWINGS

FIG. 1 is a schematic, cross-sectional view, cut away, of a portion of a conventional two-stroke cycle engine.

FIG. 2*a* is a front elevational view of a connecting rod in accordance with the invention.

FIG. 2*b* is a side elevational view of the connecting rod shown in FIG. 2*a*.

FIG. 4 is a schematic, cross-sectional, cut away of a compressor in accordance with the invention.

FIG. 5 is a front elevational view of another embodiment of a connecting rod in accordance with the invention.

DETAILED DESCRIPTION OF THE PREFERRED EMBODIMENTS

Figure 3A:
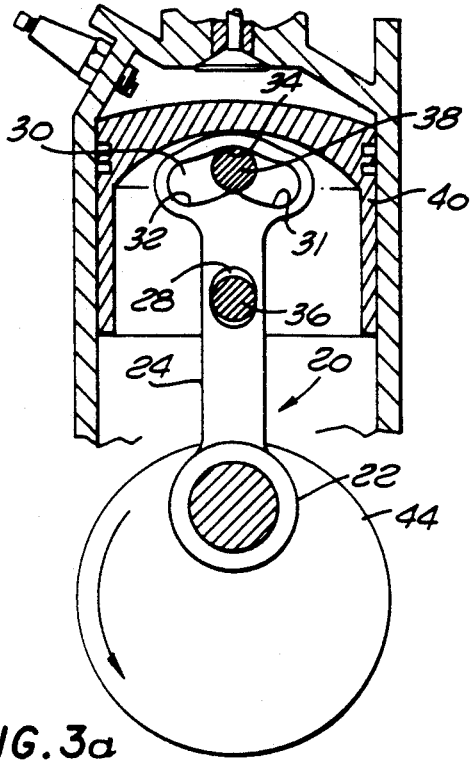
FIGS. 3*a*–3*d* are schematic, cross-sectional views, cut away, of a portion of a two-stroke cycle engine in accordance with the invention, illustrating the positions of the piston and the connecting rod and associated components at various times during the two-stroke cycle.
Figure 3B:
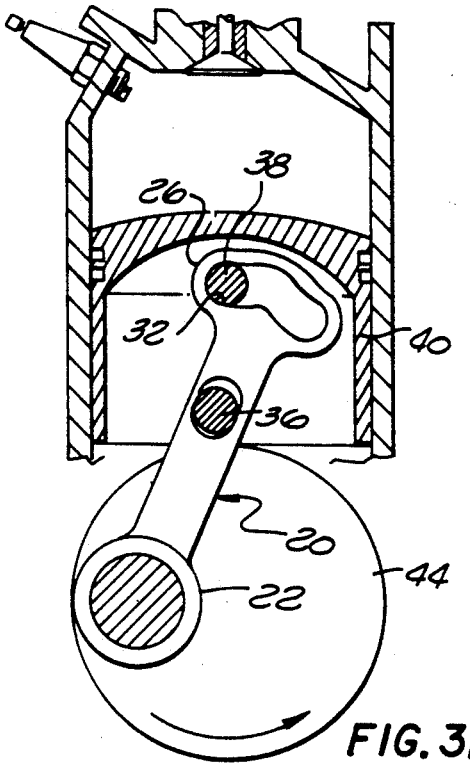
Figure 3C:
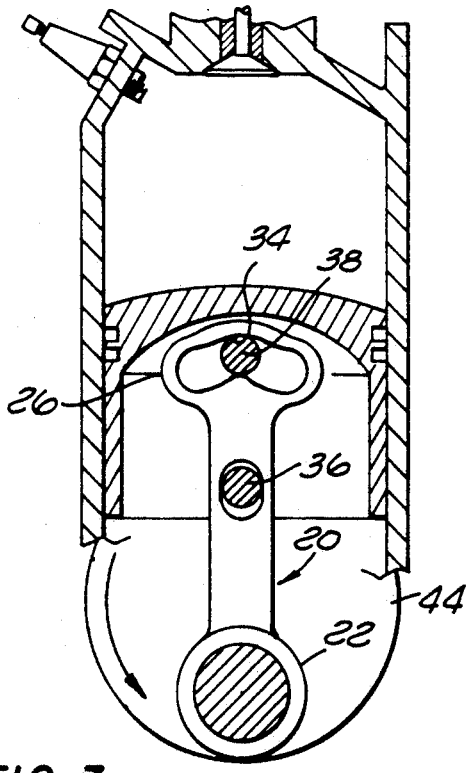

As required, detailed illustrative embodiments of the invention are disclosed herein. However, it is to be understood that the embodiments merely exemplify the invention which can take forms that are different from the specific illustrated embodiments disclosed. Therefore, specific structural and functional details are not to be interpreted as necessarily limiting, but as a basis for the claims which define the scope of the invention.

Referring to FIG. 1, there is shown a portion of a conventional single piston, two-stroke cycle engine 10. A connecting rod 11 links a piston 12, which reciprocates in compression strokes and power strokes, with a crankshaft 13, which rotates through 360°. The rotating crankshaft 13 pulls the piston 12 down, creating low pressure in the cylinder 14. The inlet valve 15 opens and a mixture of fuel and air enters the compression chamber 17. The rotating crankshaft 13 then pushes the piston 12 up compressing the mixture of fuel and air. At the top of the stroke, the spark plug 18 fires igniting the mixture.

The connecting rod 11 serves to transform the reciprocating motion of the piston 12 into rotary motion at the crankshaft 13. A single piston pin 19 pivotally connects one end of the connecting rod 11 to the piston 12 and permits lateral oscillating motion of the connecting rod with reciprocating motion of the piston. The other end of the connecting rod 11 is attached to the crank shaft 13 and permits the lateral oscillating motion of the connecting rod with rotational motion of the crank shaft.

Referring now to FIGS. *2a* and *2b*, there is shown a connecting rod 20 in accordance with the present invention. The connecting rod 20 has a lower end portion 22, a central portion 24 and an upper end portion 26. The lower end portion 22 contains an opening 27 to receive a connecting rod bearing (not shown). Other means for connecting the crank shaft and translating the lateral oscillating motion of the connecting rod 20 into the rotational motion of the crank shaft are known in the art.

The central portion 24 contains a central portion opening 28 having side and end walls for receiving a portion of a lower piston pin 36. The maximum width between the side walls of the central portion opening 28 is substantially the same as the diameter of the portion of the lower piston pin 36 to be received in the central portion opening. The length of the central portion opening 28 is such that there is no appreciable contact between its end walls and the lower piston pin 36 during the reciprocation of the piston 40, i.e., the end walls of the central portion opening do not interfere with the reciprocation of the piston, as would occur if the end walls hit the lower piston pin, as the central portion opening slid along the lower piston pin. Consequently, the side walls of the central portion 24 are free to pivot about the lower piston pin 36, while the central portion opening slides along the piston pin.

The upper end portion 26 contains an upper end portion opening 30 for receiving a portion of an upper piston pin 38. The upper end portion opening 30 has side and end walls defining a compression region 31, a power region 32 and a transition region 34, located between the compression and the power regions.

The maximum width between the side walls of the upper end portion opening 30 is substantially the same as the diameter of the portion of the upper piston pin 38 to be received in the upper end portion opening. The length of the upper end portion opening 30 is such that there is no appreciable contact between the end walls and the upper piston pin 38, at any time during the reciprocation of the piston 40, i.e., the end walls of the upper end portion opening do not interfere with the reciprocation of the piston, as would occur if the upper piston pin hit the end walls as the upper portion opening traveled along the upper piston pin. Accordingly, the side walls of the upper end portion opening 30 are free to slide over the length of the upper piston pin 38, but the upper piston pin is not free to move across the width of the upper end portion opening.

The cross-section of the upper portion opening 30 describes a curve represented as midline 39. As can best be seen from FIGS. *3a–3d*, the radius of the curve in the compression region 31 and the power region 32 is substantially equal to the distance between the two piston pins 36 and 38. The distance between the piston pins 36 and 38 and their location in the piston 40 is such that the end of the upper end portion 26 of the connecting rod 20 does not come into contact with the wall of the piston at any point on the path followed by the second end portion of the connecting rod.

During the compression stroke, the side walls of the compression region 31 slide over the upper piston pin 38, thereby moving the upper piston pin in substantial concert with the rotation of the crank shaft 44. While the upper piston pin 38 moves in convert with the rotation of the crank shaft 44, the side walls of the central portion opening 28 remain substantially stationary in relation to the lower piston pin 36. Consequently, when the upper piston pin 38 is in the compression region 31, the connecting rod 20 drives the piston 40 up in a normal compression stroke.

Similarly, during the power stroke, the side walls of the power region 32 slide over the upper piston pin 38, thereby moving the upper piston pin in concert with the rotation of the crank shaft 44. While the upper piston pin 38 moves in convert with the rotation of the crank shaft 44, the side walls of the central portion opening 28 remain substantially stationary in relation to the lower piston pin 36. Therefore, when the upper piston pin 38 is in the power region 32, the connecting rod 20 drives the piston 40 in a normal power stroke.

The side walls of the upper end portion opening 30 also define a transition region 34 located between the compression region 31 and the power region 32. The optimal shape of the transition region 34 is chosen to provide the particular characteristics required for a particular engine. The shape will vary depending upon the specifications of the engine and the fuel and will be readily determinable by one skilled in the pertinent art. Generally, the transition region 34 affects the movement of the piston 40, for the period of time that it takes the crank shaft 44 to rotate from about 4° to about 40°. The combustion and the more favorable the angle between the connecting rod and the crankshaft.

The walls of the transition region alter the path followed by the upper end portion 26, so that the upper end portion does not follow the same curve as when it is in the compression and power regions 31 and 32. When the walls of the transition region 34 slide over the upper piston pin 38, the piston 40 stops moving in convert within opposition to the rotation of the crank shaft 44.

The transition region 34 has two components—a compression component corresponding to that portion of the transition region between the compression region 31 and BDC and a power component corresponding to that portion of the transition region between BDC and the power region 32. Approaching BDC, as the walls of the power component of the transition region 34 slide over the upper piston pin 38, they cause the piston 40 to move up. This is possible, because t he elongated length of the central portion opening 28 allows the central portion 26 to freely move, in relation to the piston 40, when the upper piston pin 38 is urged upward. The upward movement of the piston 38 opposes the downward movement of the connecting rod 20 caused by the rotation of the crank shaft 44. When the magnitude of the two movements equal one another, they cancel each other's effect on the movement of the piston 40 and create a period of dwell.

The particular shape of the compression component depends on the combustion characteristics of the fuel being used and the RPM of the engine. In a preferred embodiment, the walls of the compression component slide over the second piston pin 38 for the period of time it takes the crank shaft 44 to rotate about 20°.

Moving from BDC, as the walls of the compression component of the dwell region 34 slide over the upper piston pin 38, the walls of the central portion opening 28 move down in relation to the lower piston pin 36, with the piston 40 moving down in relation to the rotation of the crank shaft 44. The downward movement of the piston 40 opposes the upward movement created by the rotation of the crank shaft 44. When the magnitude of the two movements equal one another, they cancel one another's effect on the movement of the piston 40 and create a period of dwell.

The particular shape of the power component depends on the characteristics of the torque to be transmitted to the crank shaft. In a preferred embodiment, the power component slides over the second piston pin 38 for the period of time it takes the crank shaft 44 to rotate about 20°.

FIGS. *3a–3d* illustrate a portion of a single piston, two-stroke engine in accordance with the invention, and show the positions of the piston-connecting rod assembly and associated components at various times during the two-stroke cycle. In FIG. *3a*, the piston 40 is at top dead center. The upper piston pin 38 is located midway through the transition region 38 and the lower piston pin 36 is located at its uppermost point in relation to the central portion opening 28.

The walls of the transition region 34 create a transition, on the order of 40°, based on the rotation of the crank shaft 44. Approaching TDC, the walls of the compression component of the transition region 34 slid over the upper piston pin 38 and caused the piston 40 to move up in relation to the connecting rod 20. The upward movement of the piston 40 caused by the walls of the compression component enhanced the upward movement of the connecting rod 20 caused by the rotation of the crankshaft 44. The magnitudes of the movements were equal for a period of about 20° rotation of the crank shaft 44 and, consequently, an accelerated upward movement of the piston 40 (corresponding to a compression stroke) occurred for the period the upper piston pin 38 was in contact with the walls of the compression component of the transition region 34.

Next, leaving TDC, the walls of the power component of the dwell region 34 will slide over the upper piston pin 38 and cause the piston 40 to move down in relation to the connecting rod 20. The downward movement of the piston 40 will enhance the downward movement of the connecting rod 20 caused by the rotation of the crankshaft 44. The magnitudes of the movements will be equal for a period of about 20° rotation of the crank shaft 44 and, consequently, the downward movement of the piston 40 (corresponding to a power stroke) will be accelerated for the period the upper piston pin 38 is in contact with the walls of the power component of the dwell region 34.

In FIG. *3b*, the piston 40 is at 90° from TDC, midway through the power stroke. The upper piston pin 38 is located at the furthest point in the power region 32 and the lower piston pin 36 is located at its lowermost point in relation to the central portion opening 28.

FIG. *3b* illustrates how the central portion 24 pivots around the side walls of the central portion opening 28 during the power stroke. It also illustrates the shape of the power region 32—a curve with a radius equal to the distance between the lower and upper piston pins 36 and 38. As long as the walls of the power region 32 slide over the upper piston pin 38, the piston moves downward in a normal power stroke.

In FIG. *3c*, the piston 40 is at bottom dead center. The upper piston pin 38 is again located midway through the transition region 34 and the lower piston pin 36 is again located at its uppermost point in relation to the central portion opening 28. The walls of the power component of the dwell region 34 slid over the upper piston pin 38 and caused piston 40 to move up in relation to the connecting rod 20. The upward movement of the piston 40 opposed the downward movement of the connecting rod 20 imparted by the rotation of the crankshaft 44. The magnitudes of the movements were equal for a period of about 20° rotation of the crank shaft 44 and, consequently, no downward movement of the piston 40 (corresponding to a power stroke) occurred for the period the upper piston pin 38 is in contact with the walls of the power component of transition region 32.

Next, the walls of the compression component of the dwell region 34 will slide over the upper piston pin 38 and cause the piston 40 to move down in relation to the connecting rod 20. The downward movement of the piston 40 will oppose the upward movement of the connecting rod caused by the rotation of the crankshaft 44. The magnitudes of the movements will be equal for a period of about 20° rotation of the crank shaft 44 and, consequently, the upward movement of the piston 40 (corresponding to a compression stroke) will not begin for the period the upper piston pin 38 is in contact with the walls of the power component of the transition region 34.

In FIG. *3d*, the piston 40 is at 270° from TDC, midway through the compression stroke. The upper piston pin 38 is located at the furthest point in the compression region 31 and the lower piston pin 36 is located at its lowermost point in relation to the central portion opening 28.

Figure 3D:
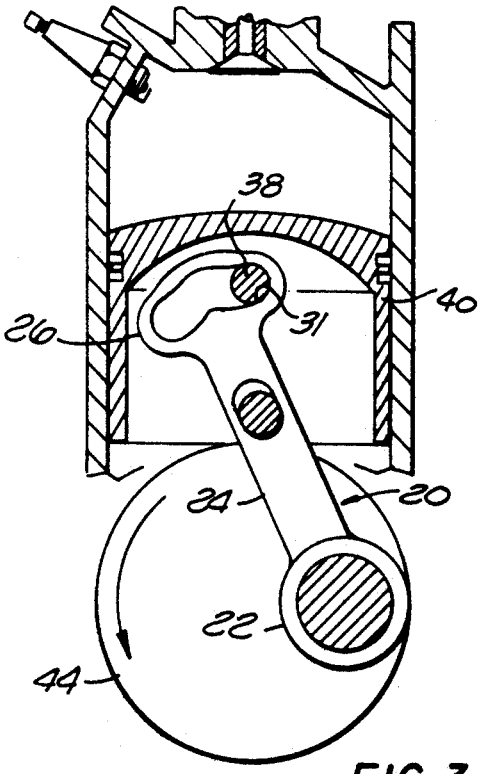

FIG. 3*d* illustrates how the central portion 24 o pivots around the side walls of the central portion opening 28 during the compression stroke. It also illustrates the shape of the compression region 31—a curve with a radius equal to the distance between the lower and upper piston pins 36 and 38. As long as the walls of the compression region 31 slide over the upper piston pin 38, the piston moves upward in concert with the upward in a power stroke.

Referring now to FIG. 4, there is shown a compressor in accordance with the invention which includes the connecting rod shown in FIG. 2. The connecting rod 52 links a piston 54, which reciprocates in compression strokes and power strokes, with a crankshaft 56, which is rotated by a driving means (not shown). The rotating crankshaft 56 pulls the piston 54 down, creating low pressure in the cylinder 58. An inlet valve (not shown) opens and air enters the compression chamber 60. The rotating crankshaft 56 then pushes the piston 54 up the cylinder compressing the air and forcing it out through an outlet valve 62.

FIG. 5 illustrates an alternative embodiment of a connecting rod 63 in accordance with the invention. In this embodiment, the upper end portion 64 has an upper end portion opening 66 which is elongated.

The central portion 72 has a central portion opening 74 having side and end walls defining a compression region 76, a power region 78, and a transition region 80, disposed between the compression and the power regions. The compression region 76 causes the piston 70 to move in concert with the rotation of the crank shaft during the compression stroke, the power region causes the piston to move in concert with the rotation of the crank shaft during the power stroke, and the transition region 80 causes the piston to cease moving in concert with the rotation of the crank shaft between the compression and power strokes.

The length of the upper end portion opening 66 is sufficient that its ends do not interfere with the reciprocation of the piston 70 and the maximum width of the upper portion opening is substantially the same as the diameter of the portion of the upper piston pin to be received in the opening. The length of the central portion opening 74 is sufficient that its ends do not interfere with the reciprocation of the maximum piston 70 and the width of the central portion opening is substantially the same as the diameter of the portion of the lower piston pin 82 to be received in the opening. With this embodiment it is possible to create periods of transition which last for about 120°, based on the rotation of the crank shaft. Transitions of this length are particularly useful in engines which run on a Stirling cycle.

In accordance with this, in a specific embodiment, a Mitsubishi 4000 two-stroke engine was modified to include a piston-connecting rod assembly in accordance with the invention. The connecting rod has a length of about 3.745 inches. The lower end portion has a thickness of about 0.390 inch. The lower end portion contains an aperture having a diameter of about 0.7875 inch, for receiving a connecting rod bearing.

The central portion has a thickness of about 0.150 inch. The central portion contains an elongated central portion opening. The walls defining the ends of the central portion opening are semicircular and have a diameter of about 0.3440 inch. The distance between the centers of the two semicircles is about 0.115 inch. The distance between the center of the aperture for connecting the crank shaft and the center of the upper semicircle is about 1.765 inch.

The upper end portion is adapted to slide over a piston pin having a diameter of about 0.3440 inch. The upper end portion has a thickness of about 0.150 inch. The upper end portion contains an end portion opening having compression, power and transition regions. The distance between the end portion opening and the outside of the upper end portion is about 0.095 inch.

The mid-line of the compression and power regions forms a curve having a radius of about 1.025 inch, as measured from a point about 0.0285 inch below the center of the center portion opening. The outer ends of the of the compression and power regions are arcs having a radius of about 0.280 inch, measured from a point on the 1.025 inch radius curve which is about 9.4° from the longitudinal axis of the connecting rod. The middle of the bottom of the transition region is located 0.700 inch from a point about 0.0285 inch below the center of the center, portion opening. The center of the transition region forms an arc having a radius of about 0.380 inch, as measured from the middle of the bottom of the transition region.

It, of course, will be appreciated by those skilled in the art that changes and modifications in various of the details of the embodiment which has been described, can be made without departing from the spirit or scope of the invention.

What I claim and desire to protect by letters patent is:

1. A connecting rod for connecting a crank shaft, for rotating, with a piston carrying first and second piston pins, for reciprocating in compression strokes and power strokes, comprising (a) a first end portion having means for connecting said first end portion to the crank shaft;

(b) a central portion having an elongated central portion opening for receiving a portion of the first piston pin; and (c) a second end portion having an elongated end portion opening for receiving a portion of the second piston pin.

2. A connecting rod in accordance with claim 1, wherein said central portion opening has a maximum width which is substantially the same as the diameter of said portion of the first piston pin to be received in said opening and wherein the wall structure for said end portion opening includes a first region, a second region, and a third region, the midline of said first region and said second region substantially following a curve having a radius substantially equal to the distance between the first piston pin and the second piston pin and the midline of said third region altering said curve between said second and first regions.

3. A connecting rod in accordance with claim 1, wherein said central portion opening has a maximum width which is substantially the same as the diameter of said portion of the first piston pin to be received in said opening and wherein the wall structure for said end portion opening includes a first region, a second region, and a third region, said first region for causing the piston to move in concert with the rotation of the crank shaft during the power stroke, said second region for causing the piston to move in concert with the rotation of the crankshaft during the compression stroke, and said third region for causing the piston to cease moving in concert with the rotation of the crankshaft.

4. A connecting rod in accordance with claim 3, wherein said third region causes the piston to cease moving in concert with the rotation of the crankshaft for a period of from about 4° to about 40°.

5. A connecting rod in accordance with claim 1, wherein said end portion opening has a maximum width which is substantially the same as the diameter of said portion of the second piston pin to be received in said opening and wherein the wall structure for said central portion opening includes a first region, a second region, and a third region, the midline of said first region and said second region substantially following a curve having a radius substantially equal to the distance between the first piston pin and the second piston pin and the midline of said third region altering said curve between said second and first regions.

6. A connecting rod in accordance with claim 1, wherein said end portion opening has a maximum width which is substantially the same as the diameter of said portion of the second piston pin to be received in said opening and wherein the wall structure for said central portion opening includes a first region, a second region, and a third region, said first region for causing the piston to move in concert with the rotation of the crank shaft during the power stroke, said second region for causing the piston to move in concert with the rotation of the crankshaft during the compression stroke, and said third region for causing the piston to cease moving in concert with the rotation of the crankshaft.

7. A connecting rod in accordance with claim 6, wherein said third region causes the piston to cease moving in concert with the rotation of the crankshaft for a period of from about 4° to about 40°.

8. A connecting rod for connecting a crank shaft, for rotating, with a piston carrying first and second piston pins, for reciprocating in compression strokes and power strokes, comprising (a) a first end portion having means for connecting said first end portion to the crank shaft;

(b) a central portion having a central portion opening for receiving a portion of the first piston pin, said central portion opening shaped for movement of the first piston pin, relative to said opening, along said opening; and (c) a second end portion having an end portion opening for receiving a portion of the second piston pin, said end portion opening shaped for the movement of the second piston, relative to said opening, along said opening.

9. A connecting rod in accordance with claim 8, wherein said central portion opening has a maximum width which is substantially the same as the diameter of said portion of the first piston pin to be received in said opening and wherein the wall structure for said end portion opening includes a first region, a second region, and a third region, the midline of said first region and said second region substantially following a curve having a radius substantially equal to the distance between the first piston pin and the second piston pin and the midline of said third region altering said curve between said second and first regions.

10. A connecting rod in accordance with claim 8, wherein said central portion opening has a maximum width which is substantially the same as the diameter of said portion of the first piston pin to be received in said opening and wherein the wall structure for said end portion opening includes a first region, a second region, and a third region, said first region for causing the piston to move in concert with the rotation of the crank shaft during the power stroke, said second region for causing the piston to move in concert with the rotation of the crankshaft during the compression stroke, and said third region for causing the piston to cease moving in concert with the rotation of the crankshaft.

11. A connecting rod in accordance with claim 10, wherein said third region causes the piston to cease moving in concert with the rotation of the crankshaft for a period of from about 4° to about 40°.

12. A connecting rod in accordance with claim 8, wherein said end portion opening has a maximum width which is substantially the same as the diameter of said portion of the second piston pin to be received in said opening and wherein the wall structure for said central portion opening includes a first region, a second region, and a third region, the midline of said first region and said second region substantially following a curve having a radius substantially equal to the distance between the first piston pin and the second piston pin and the midline of said third region altering said curve between said second and first regions.

13. A connecting rod in accordance with claim 8, wherein said end portion opening has a maximum width which is substantially the same as the diameter of said portion of the second piston pin to be received in said opening and wherein the wall structure for said central portion opening includes a first region, a second region, and a third region, said first region for causing the piston to move in concert with the rotation of the crank shaft during the power stroke, said second region for causing the piston to move in concert with the rotation of the crankshaft during the compression stroke, and said third region for causing the piston to cease moving in concert with the rotation of the crankshaft.

14. A connecting rod in accordance with claim 13, wherein said third region causes the piston to cease moving in concert with the rotation of the crankshaft for a period of from about 4° to about 40°.

15. A connecting rod for connecting a crank shaft, for rotating, with a piston carrying first and second piston pins, for reciprocating in compression strokes and power strokes, comprising (a) a first end portion having means for connecting said first end portion to the crank shaft;

(b) a central portion having a central portion opening for receiving a portion of the first piston pin, (c) a second end portion having an end portion opening for receiving a portion of the second piston pin; and (d) one of said central portion and said second end portion openings including a first region having a midline which substantially follows a curve having a radius substantially equal to the distance between the first piston pin and the second piston pin, and a second region having a midline which follows an altered curve.

16. A connecting rod in accordance with claim 15 wherein said first region causes the piston to move in concert with the rotation of the crank shaft and said second region causes the piston to cease moving in concert with the rotation of the crankshaft 17. A connecting rod in accordance with claim 15, wherein said second region causes the piston to cease moving in concert with the rotation of the crankshaft for a period of from about 4° to about 40°.

18. A piston-connecting rod assembly for a crank shaft, for rotating, comprising:

(a) a piston, for reciprocating in compression and power strokes, carrying a first piston pin and a second piston pin; and (b) a connecting rod including, (1) a first end portion having means for connecting said first end portion to the crank shaft, (2) a central portion having an elongated central portion opening for receiving a portion of said first piston pin, and (3) a second end portion having an elongated end portion opening for receiving a portion of said second piston pin.

19. A piston-connecting rod assembly in accordance with claim 18, wherein:

(a) said central portion opening has a maximum width which is substantially the same as the diameter of said portion of said first piston pin to be received in said opening;

(b) the length of said central portion opening is sufficient that its ends do not interfere with the reciprocation of the piston;

(c) said end portion opening has a maximum width which is substantially the same as the diameter of said portion of said second piston pin to be received in said opening; and (d) the length of said end portion opening is sufficient that its ends do not interfere with the reciprocation of the piston.

20. A piston-connecting rod assembly in accordance with claim 19, wherein the wall structure for said end portion opening includes a first region, a second region, and a third region, said first region for causing the piston to move in concert with the rotation of the crank shaft during the power stroke, said second region for causing the piston to move in concert with the rotation of the crankshaft during the compression stroke, and said third region for causing the piston to cease moving in concert with the rotation of the crankshaft.

21. A piston-connecting rod assembly in accordance with claim 20, wherein the midline of said end portion opening along said first region and along said second region substantially follow a curve having a radius substantially equal to the distance between said first piston pin and said second piston pin and wherein the midline of said end portion opening along said third region alters said curve.

22. A piston-connecting rod assembly in accordance with claim 21, wherein said third region causes the piston to cease moving in concert with the rotation of the crankshaft for a period of from about 4° to about 40°.

23. A piston-connecting rod assembly in accordance with claim 19, wherein the wall structure for said central portion opening includes a first region, a second region, and a third region, said first region for causing the piston to move in concert with the rotation of the crank shaft during the power stroke, said second region for causing the piston to move in concert with the rotation of the crankshaft during the compression stroke, and said third region for causing the piston to cease moving in concert with the rotation of the crankshaft.

24. A piston-connecting rod assembly in accordance with claim 23, wherein the midline of said central portion opening along said first region and along said second region substantially follows a curve having a radius substantially equal to the distance between said first piston pin and said second piston pin and wherein the midline of said central portion opening along said third region alters said curve.

25. A piston-connecting rod assembly in accordance with claim 24, wherein said third region causes the piston to cease moving in concert with the rotation of the crankshaft for a period of from about 4° to about 40°.

26. A piston-connecting rod assembly for a crank shaft, for rotating, comprising:

(a) a piston, for reciprocating in compression and power strokes, carrying a first piston pin and a second piston pin; and (b) a connecting rod including, (1) a first end portion having means for connecting said first end portion to the crank shaft, (2) a central portion having a central portion opening for receiving a portion of said first piston pin, said central portion opening shaped for movement of said first piston pin, relative to said opening, along said opening; and (3) a second end portion having an end portion opening for receiving a portion of said second piston pin, said second end portion opening shaped for movement of said second piston pin, relative to said opening, along said opening.

27. A piston-connecting rod assembly in accordance with claim 26, wherein:

(a) said central portion opening has a maximum width which is substantially the same as the diameter of said portion of said first piston pin to be received in said opening;

(b) the length of said central portion opening is sufficient that its ends do not interfere with the reciprocation of the piston;

(c) said end portion opening has a maximum width which is substantially the same as the diameter of said portion of said second piston pin to be received in said opening; and (d) the length of said end portion opening is sufficient that its ends do not interfere with the reciprocation of the piston.

28. A piston-connecting rod assembly in accordance with claim 27, wherein the wall structure for said end portion opening includes a first region, a second region, and a third region, the midline of said first region and said second region substantially following a curve having a radius substantially equal to the distance between said first piston pin and said second piston pin and the midline of said third region altering said curve between said second and first regions.

29. A piston-connecting rod assembly in accordance with claim 27, wherein said end portin opening includes a first region, a second region, and a third region, said first region for causing the piston to move in concert with the rotation of the crank shaft during the power stroke, said second region for causing the piston to move in concert with the rotation of the crank shaft during the power stroke, said second region for causing the piston to move in concert with the rotation of the crankshaft during the compression stroke, and said third region for causing the piston to cease moving in concert with the rotation of the crankshaft.

30. A piston-connecting rod assembly in accordance with claim 29, wherein said third region causes the piston to cease moving in concert with the rotation of the crankshaft for a period of from about 4° to about 40°.

31. A piston-connecting rod assembly in accordance with claim 27, wherein the wall structure for said central portion opening includes a first region, a second region, and a third region, the midline of said first region and said second region substantially following a curve having a radius substantially equal to the distance between said first piston pin and said second piston pin and the midline of said third region altering said curve between said second and first regions.

32. A piston-connecting rod assembly in accordance with claim 27, wherein said central portion opening includes a first region, a second region, and a third region, said first region for causing the piston to move in concert with the rotation of the crank shaft during the power stroke, said second region for causing the piston to move in concert with the rotation of the crankshaft during the compression stroke, and said third region for causing the piston to cease moving in concert with the rotation of the crankshaft.

33. A piston-connecting rod assembly in accordance with claim 32, wherein said third region causes the piston to cease moving in concert with the rotation of the crankshaft for a period of from about 4° to about 40°.

34. A piston-connecting rod assembly for a crank shaft, for rotating, comprising:

(a) a piston, for reciprocating in compression and power strokes, carrying a first piston pin and a second piston pin; and (b) a connecting rod including, (1) a first end portion having means for connecting said first end portion to the crank shaft, (2) a central portion having a central portion opening for receiving a portion of said first piston pin; and (3) a second end portion having an end portion opening for receiving a portion of said second piston pin;

(c) one of said central portion and said second end portion openings including a first region having a midline which substantially follows a curve having a radius substantially equal to the distance between said first piston pin and said second piston pin, and a second region, having a midline which follows an altered curve.

35. A piston-connecting rod assembly in accordance with claim 34, wherein:

(a) said central portion opening has a maximum width which is substantially the same as the diameter of said portion of said first piston pin to be received in said opening;

(b) the length of said central portion opening is sufficient that its ends do not interfere with the reciprocation of the piston;

(c) the maximum width of said end portion opening is substantially the same as the diameter of said portion of said second piston pin to be received in said opening; and (d) the length of said end portion opening is sufficient that its ends do not interfere with the reciprocation of the piston.

36. A piston-connecting rod assembly in accordance with claim 34 wherein said first region causes the piston to move in concert with the rotation of the crank shaft and said second region causes the piston to cease moving in concert with the rotation of the crankshaft.

37. A piston-connecting rod assembly in accordance with claim 34, wherein said second region causes the piston to cease moving in concert with the rotation of the crankshaft for a period of from about 4° to about 40°.

38. An internal combustion engine having a crank shaft for rotating, comprising:

(a) a piston, for reciprocating in compression and power strokes, carrying a first piston pin and a second piston pin; and (b) a connecting rod including, (1) a first end portion having means for connecting said first end portin to the crank shaft, (2) a central portion having an elongated central portion opening for receiving a portion of said first piston pin, and (3) a second end portion having an elongated end portion opening for receiving a portion of said second piston pin.

39. An internal combustion engine in accordance with claim 38, wherein the wall structure for said end portion opening includes a first region, a second region, and a third region, the midline of said end portion opening along said first region and along said second region substantially following a curve having a radius substantially equal to the distance between said first piston pin and said second piston pin and the midline of said end portion opening along said third region altering said curve.

40. An internal combustion engine in accordance with claim 38, wherein the wall structure for said central portion opening includes a first region, a second region, and a third region, the midline of said central portion opening along said first region and along said second region substantially following a curve having a radius substantially equal to the distance between said first piston pin and said second piston pin and the midline of said end portion opening along said third region altering said curve.

41. An internal combustion engine having a crank shaft for rotating, comprising:

(a) a piston, for reciprocating in compression and power strokes, carrying a first piston pin and a second piston pin; and (b) a connecting rod including, (1) a first end portion having means for connecting said first end portion to the crank shaft, (2) a central portion having a central portion opening for receiving a portion of said first piston pin, said central portion opening shaped for movement of said piston pin, relative to said opening, along said opening; and (3) a second end portion having an end portion opening for receiving a portion of said second piston pin, said second end portion opening shaped for movement of said second piston pin, relative to said opening, along said opening.

42. An internal combustion engine in accordance with claim 41, wherein the wall structure for said end portion opening includes a first region, a second region, and a third region, the midline of said end portion opening along said first region and along said second region substantially following a curve having a radius substantially equal to the distance between said first piston pin and said second piston pin and the midline of said end opening portion along said third region altering said curve.

43. An internal combustion engine in accordance with claim 41, wherein the wall structure for said central portin opening includes a first region, a second region, and a third region, the midline of said central portion opening along said first region and along said second region substantially following a curve having a radius substantially equal to the distance between said first piston pin and said second piston pin and the midline of said central portion opening portion along said third region altering said curve.

44. An internal combustion engine having a crank shaft for rotating, comprising:

(a) a piston, for reciprocating in compression and power strokes, carrying a first piston pin and a second piston pin; and (b) a connecting rod including, (1) a first end portion having means for connecting said first end portion to the crank shaft, (2) a central portion having an elongated central portion opening for receiving a portin of said first piston pin, and (3) a second end portion having an elongated end portion opening for receiving a portion of said second piston pin;

(c) one of said central portion and said second end portion openings including a first region having a midline which substantially follows a curve having a radius substantially equal to the distance between said first piston pin and said second piston pin, and a second region, having a midline which follows an altered curve.

45. An internal combustion engine in accordance with claim 44, wherein said first region causes the piston to move in convert with the rotation of the crank shaft and said second region causes the piston to cease moving in concert with the rotation of the crankshaft.

46. A compressor having a crank shaft for rotating, comprising:

(a) a piston, for reciprocating in compression and power strokes, carrying a first piston pin and a second piston pin; and (b) a connecting rod including, (1) a first end portion having means for connecting said first end portion to the crank shaft, (2) a central portin having an elongated central portion opening for receiving a portion of said first piston pin, and (3) a second end portion having an elongated end portion opening for receiving a portion of said second piston pin.

47. A compressor in accordance with claim 46, wherein the wall structure for said end portion opening includes a first region, a second region, and a third region, the midline of said end portion opening along said first region and along said second region substantially following a curve having a radius substantially equal to the distance between said first piston pin and said second piston pin and the midline of said end portion opening along said third region altering said curve.

48. A compressor in accordance with claim 46, wherein the wall structure for said central portion opening includes a first region, a second region, and a third region, the midline of said central portion opening along said first region and along said second region substantially following a curve having a radius substantially equal to the distance between said first piston pin and said second piston pin and the midline of said central portion opening along said third region altering said curve.

49. A compressor having a crank shaft for rotating, comprising:

(a) a piston, for reciprocating in compression and power strokes, carrying a first piston pin and a second piston pin; and (b) a connecting rod including, (1) a first end portion having means for connecting said first end portion to the crank shaft, (2) a central portion having a central portion opening for receiving a portin of said first piston pin, said central portion opening shaped for movement of said first piston pin, relative to said opening, along said opening; and (3) a second end portion having an end portion opening for receiving a portion of said second piston pin, said end portion opening shaped for movement of said second piston pin, relative to said opening, along said opening.

50. A compressor in accordance with claim 49, wherein the wall structure for said end portin opening includes a first region, a second region, and a third region, the midline of said end portion opening along said first region and along said second region substantially following a curve having a radius substantially equal to the distance between said first piston pin and said second piston pin and the midline of said end portion opening along said third region altering said curve.

51. A compressor in accordance with claim 49, wherein the wall structure for said central portion opening includes a first region, a second region, and a third region, the midline of said central portion opening along said first region and along said second region substantially following a curve having a radius substantially equal to the distance between said first piston pin and said second piston pin and the midline of said central portion opening along said third region altering said curve.

52. A compressor having a crank shaft for rotating, comprising:

(a) a piston, for reciprocating in compression and power strokes, carrying a first piston pin and a second piston pin; and (b) a connecting rod including, (1) a first end portion having means for connecting said first end portion to the crank shaft, (2) a central portion having a central portion opening for receiving a portion of said first piston pin, and (3) a second end portion having an end portion opening for receiving a portion of said second piston pin;

(c) one of said central portion and said second end portion openings including a first region having a midline which substantially follows a curve having a radius substantially equal to the distance between said first piston pin and said second piston pin, and a second region, having a midline which follows an altered curve.

53. A compressor in accordance with claim 48 wherein said first region causes the piston to move in concert with the rotation of the crank shaft and said second region causes the piston to cease moving in concert with the rotation of the crankshaft.

* * * * *